US007604757B2

(12) United States Patent
Yasuda

(10) Patent No.: US 7,604,757 B2
(45) Date of Patent: Oct. 20, 2009

(54) TRANSPARENT CONDUCTIVE MATERIAL AND TRANSPARENT CONDUCTOR

(75) Inventor: Noriyuki Yasuda, Tokyo (JP)

(73) Assignee: TDK Corporation, Chuo-ku, Tokyo (JP)

( * ) Notice: Subject to any disclaimer, the term of this patent is extended or adjusted under 35 U.S.C. 154(b) by 0 days.

(21) Appl. No.: 12/054,152

(22) Filed: Mar. 24, 2008

(65) Prior Publication Data

US 2008/0237547 A1 Oct. 2, 2008

(30) Foreign Application Priority Data

Mar. 30, 2007 (JP) ..... P2007-094685

(51) Int. Cl.
*H01B 1/04* (2006.01)

(52) U.S. Cl. ..... 252/519.31; 428/220; 428/447; 428/461; 428/611; 524/430

(58) Field of Classification Search ..... 252/519.31; 345/173; 428/220, 461, 611; 493/42; 524/430
See application file for complete search history.

(56) References Cited

U.S. PATENT DOCUMENTS 4,758,464 A * 7/1988 Masuzawa et al. ..... 428/220
4,911,684 A * 3/1990 Duke et al. ..... 493/42
5,504,133 A * 4/1996 Murouchi et al. ..... 524/430
2004/0017364 A1* 1/2004 Tanaka et al. ..... 345/173
2006/0060828 A1* 3/2006 Yasuda ..... 252/519.31
2008/0020228 A1* 1/2008 Inoue et al. ..... 428/611
2008/0318072 A1* 12/2008 Kawabata et al. ..... 428/461

FOREIGN PATENT DOCUMENTS

| | | |
|---|---|---|
| JP | 11-273874 | 10/1999 |
| JP | 3072862 | 6/2000 |
| JP | 3774117 | 2/2006 |
| JP | 2006-92869 | 4/2006 |

* cited by examiner

*Primary Examiner*—Mark Kopec
*Assistant Examiner*—Khanh Tuan Nguyen
(74) *Attorney, Agent, or Firm*—Drinker Biddle & Reath LLP

(57) ABSTRACT

A transparent conductive material contains a conductive particle, a polyfunctional compound, and an organic compound having a side chain including an ester group, while the ester group is expressed by —COOR, where R is a substituted or unsubstituted alkyl group having a carbon atom number of 2 or greater.

9 Claims, 2 Drawing Sheets

TRANSPARENT CONDUCTIVE MATERIAL AND TRANSPARENT CONDUCTOR

BACKGROUND OF THE INVENTION

1. Field of the Invention

The present invention relates to a transparent conductive material and a transparent conductor.

2. Related Background Art

Transparent electrodes have been employed in LCDs, PDPs, organic ELs, touch panels, and the like, while films of conductors such as ITO (Indium Tin Oxide) have been formed by sputtering, vapor deposition, and the like on base materials so as to be used as such transparent electrodes. Some transparent conductors have a structure in which conductive particles such as ITO are dispersed in a resin.

The transparent conductors constructed such as to disperse conductive particles in a resin may have a problem of deteriorating resistance values with time, whereby the touch panels and the like may fail to operate stably. Therefore, various transparent conductors have been proposed in order to ameliorate the problem of resistance value deterioration with time (see Japanese Patent No. 3072862).

SUMMARY OF THE INVENTION

Since the transparent conductors used in the touch panels and the like may repeatedly be subjected to shocks caused by pressures, high durability is required as their film property.

In view of the circumstances mentioned above, it is an object of the present invention to provide a transparent conductive material and transparent conductor which can improve the durability of the transparent conductor.

The inventors conducted diligent studies in order to solve the above-mentioned problem and have found that the length of alkyl parts in ester groups which are side chains of binder resins in the transparent conductors affects the durability of the transparent conductors. As a result of further diligent studies, the inventors have found that the following invention can solve the above-mentioned problem, thereby achieving the present invention.

One aspect of the present invention is a transparent conductive material containing a conductive particle, a polyfunctional compound, and an organic compound having a side chain including an ester group; wherein the ester group is expressed by the following formula:

—COOR where R is a substituted or unsubstituted alkyl group having a carbon atom number of 2 or greater.

This transparent conductive material can improve the durability of transparent conductors. Though not elucidated yet, a mechanism by which the durability of transparent conductors improves as mentioned above is assumed to be as follows. When a transparent conductor contains an organic compound equipped with a side chain including an ester group having a long alkyl group as mentioned above, alkyl groups of the organic compound are likely to become entangled with each other. Also, as the molecular weight of the alkyl groups becomes greater, the glass transition temperature (Tg) of the organic compound decreases, thereby increasing its flexibility and improving its surface lubricity. In addition, the transparent conductive material containing a polyfunctional compound makes it easy for the long alkyl group to get entangled with a high-molecular network, which is formed by a reaction between polyfunctional compounds, at the time when the organic compound enters a space within the high-molecular network. The inventors assume that the durability of transparent conductors improves because of the foregoing.

Preferably, the alkyl group is a linear alkyl group. When the alkyl group is a linear alkyl group, its molecules are located closer to each other than those in the case of a branched alkyl group, thus yielding a structure having less voids at a molecular level. This can effectively deter water molecules from passing through a transparent conductor formed by using the transparent conductive material. As a consequence, conductive particles can be restrained from dissociating from each other by swelling of the transparent conductor, whereby the transparent conductor can fully be kept from deteriorating the resistance value with time.

Preferably, the alkyl group is a fluorine-substituted alkyl group. The fluorine-substituted alkyl group has such a low surface energy that water molecules which are polar molecules are hard to be adsorbed thereby. Therefore, a transparent conductor formed by using the transparent conductive material can block the adsorption of water molecules more effectively than one using an organic compound having an ester group including an alkyl group substituted with an atom other than a fluorine atom. As a consequence, conductive particles can be restrained from dissociating from each other by swelling of the transparent conductor, whereby the transparent conductor can fully be kept from deteriorating the resistance value with time. Further, the fluorine atom has a larger ionic radius, so that the fluorine-substituted alkyl group is likely to become more linear. Hence, the surface of the resulting transparent conductor becomes slippery and reduces friction, thereby enhancing the lubricity and further improving the durability.

Preferably, the organic compound has a weight-average molecular weight of at least 100,000. This is more advantageous than the case where the organic compound has a weight-average molecular weight of less than 100,000 in that cracks are harder to occur therein.

Another aspect of the present invention is a transparent conductor containing a conductive particle, a crosslinked product, and a binder resin having a side chain including an ester group; wherein the ester group is expressed by the following formula:

—COOR where R is a substituted or unsubstituted alkyl group having a carbon atom number of 2 or greater.

This transparent conductor can improve the durability. Though not elucidated yet, a mechanism by which the durability of transparent conductor improves as mentioned above is assumed to be as follows. When a transparent conductor contains a binder resin equipped with a side chain having an ester group including a long alkyl group as mentioned above, alkyl groups of the binder resin are likely to become entangled with each other. Also, as the molecular weight of the alkyl groups becomes greater, the glass transition temperature decreases, thereby increasing the flexibility and improving the surface lubricity. The inventors assume that the durability improves because of the foregoing.

Preferably, the alkyl group is a linear alkyl group.

When the alkyl group is a linear alkyl group, as mentioned above, the transparent conductor can more fully be kept from deteriorating the resistance value with time than in the case where the alkyl group is a branched alkyl group.

Preferably, the alkyl group is a fluorine-substituted alkyl group.

This can fully restrain the resistance value of the transparent conductor from deteriorating with time. It is also advantageous in that the durability improves more.

DESCRIPTION OF THE PREFERRED EMBODIMENTS

Figure 1:
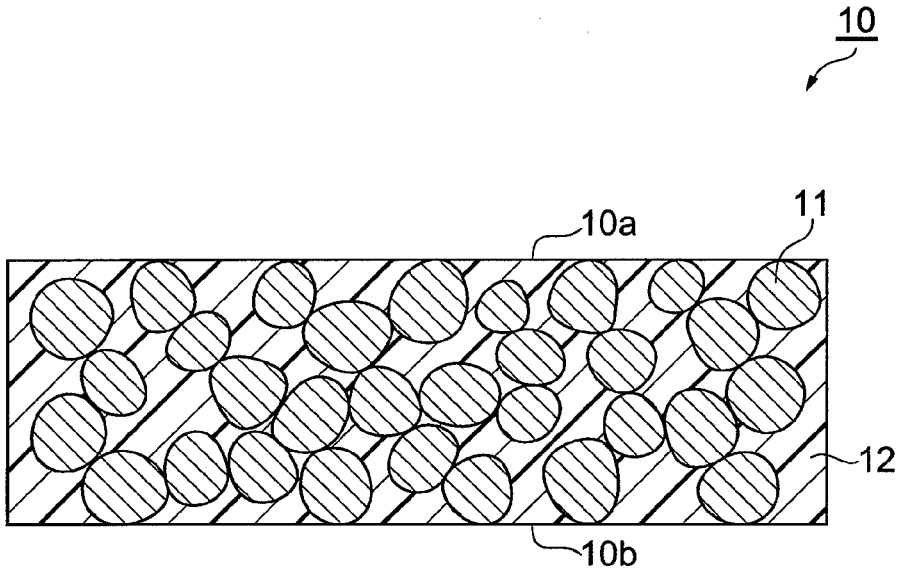
FIG. 1 is a schematic sectional view showing a first embodiment of the transparent conductor in accordance with the present invention.

In the following, preferred embodiments of the present invention will be explained in detail with reference to the drawings when necessary. In the drawings, the same constituents will be referred to with the same numerals while omitting their overlapping descriptions. The ratios of dimensions in the drawings are not limited to those depicted.

First Embodiment of Transparent Conductor

To begin with, the first embodiment of the transparent conductor in accordance with the present invention will be explained.

FIG. 1 is a schematic sectional view showing the first embodiment of the transparent conductor in accordance with the present invention. As shown in FIG. 1, the transparent conductor 10 in accordance with this embodiment contains conductive particles 11 and a binder resin 12.

The conductive particles 11 fill the inside of the transparent conductor 10 and are firmly attached to the binder resin 12.

The conductive particles 11 are preferably in contact with each other, while some of them are exposed to a surface 10*a* or 10*b* of the transparent conductor 10. As a consequence, the transparent conductor 10 can have a sufficient conductivity.

On the other hand, the binder resin 12 has a side chain including an ester group, while the ester group is expressed by the following formula:

—COOR where R is a substituted or unsubstituted alkyl group having a carbon atom number of 2 or greater.

The transparent conductor 10 contains a high-molecular crosslinked product. Though the binder resin 12 may be a high-molecular crosslinked product by itself, the transparent conductor 10 may contain a high-molecular crosslinked product different from the binder resin 12.

The transparent conductor 10 can improve the durability.

The transparent conductor 10 is formed by using a transparent conductive material. Therefore, the transparent conductive material will be explained further in detail.

Transparent Conductive Material

The transparent conductive material contains the conductive particles 11, an organic compound having a side chain including an ester group, and a polyfunctional compound, while the ester group in the organic compound is expressed by the following formula:

—COOR where R is a substituted or unsubstituted alkyl group having a carbon atom number of 2 or greater. The binder resin 12 may be constituted by the above-mentioned organic compound. In this case, the binder resin 12 is constructed by a non-crosslinked product, so that the transparent conductor has a cross-linked product different from the binder resin 12. The binder resin 12 may be a crosslinked product obtained by causing the organic compound and polyfunctional compound to react with each other. In this case, the binder resin 12 becomes a high-molecular crosslinked product by itself in the transparent conductor 10.

Using the above-mentioned transparent conductive material can improve the durability of the transparent conductor 10. Though not elucidated yet, its mechanism is assumed to be as follows. When a transparent conductive material contains an organic compound equipped with a side chain having an ester group including a long alkyl group as mentioned above, alkyl groups of the organic compound are likely to become entangled with each other. Also, as the molecular weight of the alkyl groups becomes greater, the glass transition temperature decreases, thereby increasing the flexibility and improving the surface lubricity. In addition, the transparent conductive material containing a polyfunctional compound makes it easy for the long alkyl group to get entangled with a high-molecular network, which is formed by a reaction between polyfunctional compounds, at the time when the organic compound enters a space within the high-molecular network. The inventors assume that the durability of the transparent conductor 10 improves because of the foregoing.

Organic Compound

The organic compound is not restricted in particular as long as it has a side chain including the ester group. Examples of the organic compound include epoxyacrylate resins, epoxy resins, acrylate resins, and methacrylate resins.

In the ester group, the alkyl group represented by R may be anything as long as it has a carbon atom number of at least 2. Examples of the alkyl group include ethyl, n-propyl, i-propyl, n-butyl, i-butyl, pentyl, hexyl, octyl, decyl, lauryl, and stearyl groups. While the alkyl group having a carbon atom number of 2 or greater can improve the durability of the transparent conductor 10, the carbon atom number is typically 20 or less in view of the compatibility with a solvent for dissolving the organic compound.

The alkyl group may be either a linear or branched alkyl group, and preferably is a linear alkyl group. When the alkyl group is a linear alkyl group, its molecules are located closer to each other than those in the case of a branched alkyl group, thus yielding a structure having less voids at a molecular level. This can effectively deter water molecules from passing through the transparent conductor 10. As a consequence, the conductive particles 11 can be restrained from dissociating from each other by swelling of the binder resin 12 in the transparent conductor 10, whereby the transparent conductor 10 can fully be kept from deteriorating the resistance value with time.

The alkyl group may be either an unsubstituted or substituted alkyl group. When the alkyl group is a substituted alkyl group, an example of substituent atoms is a fluorine atom.

A fluorine-substituted alkyl group has a low surface energy and thus exhibits a low polarity as a whole. As a consequence, water molecules which are polar molecules are hard to be adsorbed by the fluorine-substituted alkyl group. Therefore, the transparent conductor 10 can block the adsorption of water molecules more effectively than one using an organic compound having an ester group including an alkyl group substituted with an atom other than a fluorine atom. As a consequence, conductive particles 11 can be restrained from dissociating from each other by swelling of the binder resin 12 in the transparent conductor 10, whereby the transparent conductor 10 can fully be kept from deteriorating the resistance value with time. Further, the fluorine atom has a larger ionic radius, so that the fluorine-substituted alkyl group is likely to become more linear. Hence, the surface of the resulting transparent conductor 10 becomes slippery and reduces friction, thereby enhancing the lubricity and further improving the durability.

When the organic compound is an acrylate resin or methacrylate resin, the organic compound may be a homopolymer of one kind of (meth)acrylate monomers or a copolymer of a plurality of kinds of (meth)acrylate monomers. The copolymer of a plurality of kinds of (meth)acrylate monomers is preferred in particular, since it can regulate the compatibility with other components in the binder and the solvent while providing functions required.

When the organic compound is an epoxy resin or epoxy-acrylate resin, the organic compound and the polyfunctional compound can form a crosslinked product, whereby the durability can further be improved.

Preferably, the organic compound has a weight-average molecular weight of at least 100,000. This is more advantageous than the case where the organic compound has a weight-average molecular weight of less than 100,000 in that cracks are harder to occur therein.

Polyfunctional Compound

The polyfunctional compound is not limited in particular as long as it is a compound having at least two reactive functional groups within its molecule and being adapted to form the crosslinked product. It may construct the binder resin 12 by chemically combining with the organic compound in the transparent conductive material. Polyfunctional compounds may react with each other without chemically combining with the organic compound.

Examples of the polyfunctional compound include ethoxylated glycerol triacrylate, polyethylene glycol diacrylate, trimethylolpropane triacrylate, urethane-modified acrylate, ethoxylated isocyanuric acid triacrylate, dipentaerythritol hexaacrylate, decanediol diacrylate, and ethoxylated pentaerythritol tetraacrylate. These polyfunctional compounds cause polymerization reactions with the organic compound or other polyfunctional compounds. Since each polyfunctional compound contains two or more functional groups within its molecule, a crosslinking reaction proceeds reliably, thereby forming a crosslinked product.

The polyfunctional compound content in the transparent conductive material is typically 10 to 90 mass %. When the content falls within the range mentioned above, the durability, mechanical strength, and dimensional accuracy tend to become better than those in the case where the content is outside of the range.

When the organic compound is an acrylate resin or methacrylate resin, examples of a polyfunctional compound not chemically combining with such an organic compound include those having epoxy groups. In this case, though the epoxy groups do not combine with the acrylate resin or methacrylate resin, a polymerization proceeds between the epoxy groups, thereby forming a crosslinked product made of the epoxy resins alone. Here, the transparent conductor 10 contains the (meth)acrylate resin and the crosslinked product made of the epoxy resins alone as the binder resin 12 and the crosslinked product, respectively. When the polyfunctional compound has a vinyl group and an epoxy group, a copolymer crosslinked product of an acrylic resin and an epoxy resin is formed.

Conductive Particle

The conductive particles 11 are typically constituted by a transparent conductive oxide material. Though the transparent conductive oxide material is not restricted in particular as long as it has transparency and conductivity, its examples include indium oxide; indium oxide doped with at least one kind of element selected from the group consisting of tin, zinc, tellurium, silver, gallium, zirconium, hafnium, and magnesium; tin oxide; tin oxide doped with at least one kind of element selected from the group consisting of antimony, zinc, and fluorine; zinc oxide; and zinc oxide doped with at least one kind of element selected from the group consisting of aluminum, gallium, indium, boron, fluorine, and manganese. Usable as the conductive particles 11 are not only the transparent conductive oxide materials, but also metal nanoparticles, fullerenes, and carbon nanotubes.

Preferably, the conductive particles 11 are water-resistant conductive particles. Here, the "water-resistant conductive particles" refer to conductive particles which do not cause deteriorations such as increase in the resistance value with moistures. Specifically, the water-resistant conductive particles vary depending on the transparent conductive oxide material. When the transparent conductive oxide material is indium oxide or an indium mixed oxide in which indium oxide is doped with at least one kind of element selected from the group consisting of tin, zinc, tellurium, silver, gallium, zirconium, hafnium, and magnesium, examples of the water-resistant conductive particles include those causing a mixed liquid containing 1 mass % of the conductive particles to attain a pH of 3 or higher and those having a halogen element concentration of 0.2 mass % or less and causing a mixed liquid containing 1 mass % of the conductive particles to attain a pH of less than 3. When the transparent conductive oxide material is tin oxide or a tin mixed oxide in which tin oxide is doped with at least one kind of element selected from the group consisting of antimony, zinc, and fluorine, examples of the water-resistant conductive particles include those having a halogen element concentration of 1.5 mass % or greater and causing a mixed liquid containing 1 mass % of the conductive particles to attain a pH of 1 or higher. When the transparent conductive oxide material is zinc oxide or a zinc mixed oxide in which zinc oxide is doped with at least one kind of element selected from the group consisting of aluminum, gallium, indium, boron, fluorine, and manganese, examples of the water-resistant conductive particles include those causing a mixed liquid containing 1 mass % of the conductive particles to attain a pH of 4 to 9. Here, the "mixed liquid" refers to one constituted by water and the conductive particles.

When such conductive particles 11 are used, the transparent conductor 10 containing the water-resistant conductive particles 11 and binder resin 12 can more strongly prevent the resistance value from changing with time even in a high-humidity environment.

The pH adjustment of the mixed liquid containing 1 mass % of the conductive particles can be effected by washing with water, neutralization, dissociation of impurities by heating, and the like, for example, and is preferably done by neutralization, the neutralization using aqueous ammonia in particular. Using this method can easily regulate the pH of the mixed liquid and selectively elute chlorine from the conductive particles 11, thereby effectively lowering the chlorine concentration in the conductive particles 11.

Preferably, the conductive particles 11 have an average particle size of 10 nm to 80 nm. When the average particle size is less than 10 nm, the conductivity of the transparent conductor tends to be less stable than in the case where the average particle size is 10 nm or greater. Namely, though oxygen vacancies occurring in the conductive particles 11 generate conductivity in the transparent conductive material in accordance with this embodiment, the oxygen vacancies decrease when the external oxygen concentration is high, for example, in the case where the average particle size of the conductive particles 11 is less than 10 nm, whereby the conductivity may fluctuate. When the average particle size exceeds 80 nm, on the other hand, the scattering of light in the visible light wavelength region becomes greater than in the case where the average particle size is 80 nm or less, for example, whereby the transparent conductor 10 tends to lower the transmittance in the visible light wavelength region and increase the haze value.

Preferably, the conductive particles 11 have a specific surface area of 10 to 50 $m^2/g$. The scattering of visible light tends to increase when the specific surface area is less than 10 $m^2/g$, whereas the stability of the transparent conductive material tends to decrease when the specific surface area exceeds 50 $m^2/g$. The specific surface area herein refers to the value measured with a specific surface area analyzer (model: NOVA 2000 manufactured by Quantachrome) after drying a sample in vacuum at 300° C. for 30 min.

Preferably, the content of conductive particles 11 in the materials constituting the transparent conductor 10 is 10 vol % to 85 vol %. The resistance value of the transparent conductor 10 tends to increase when the content is less than 10 vol %, whereas the mechanical strength of the transparent conductor 10 tends to decrease when the content exceeds 85 vol %.

The conductive particles 11 can be manufactured as follows. The case where indium oxide doped with tin (hereinafter referred to as "ITO") is used as the conductive particles 11 will be explained here as an example.

First, indium chloride and tin chloride are coprecipitated by neutralization with an alkali (precipitation step). Salts occurring as byproducts here are eliminated by decantation or centrifugation. The resulting coprecipitate is dried, and the dried product is fired in an atmosphere and pulverized. Thus, the conductive particles 11 are manufactured. From the viewpoint of oxygen vacancy control, it will be preferred if the firing is performed in a nitrogen atmosphere or an atmosphere of a noble gas such as helium, argon, or xenon.

Other Components

Preferably, the transparent conductive material contains a component made of a monofunctional organic compound in addition to the organic compound, polyfunctional compound, and conductive particles 11. This makes it possible to yield the transparent conductor 10 whose resistance fluctuates less. The functional group included in the monofunctional organic compound is appropriately selected for supplementing the binder resin 21 with a function necessary therefore, and is aimed at providing moisture resistance. Examples of the functional group include aryl and alkyl groups. Preferred among them are methyl, ethyl, propyl, isopropyl, butyl, tertiary butyl, lauryl, stearyl, behenyl, phenyl, and naphthyl groups. Specifically, for example, adding phenoxypolyethylene glycol acrylate can firther reduce the fluctuation of resistance. When necessary, the transparent conductive material may firther contain polymerization initiators such as photopolymerization initiators for photopolymerizing the polyfunctional compound.

A method of manufacturing the transparent conductor 10 will now be explained.

First, the transparent conductive material including the conductive particles 11, the organic compound, a polyfunctional compound, and a polymerization initiator is dispersed in a liquid, so as to yield a dispersion liquid. Examples of the liquid for dispersing the transparent conductive material include saturated hydrocarbons such as hexane; aromatic hydrocarbons such as toluene and xylene; alcohols such as methanol, ethanol, propanol, and butanol; ketones such as acetone, methylethylketone, isobutylmethylketone, and diisobutylketone; esters such as ethyl acetate and butyl acetate; ethers such as tetrahydrofuran, dioxane, and diethylether; and amides such as N,N-dimethylacetamide, N,N-dimethylformamide, and N-methylpyrrolidone.

Next, the dispersion liquid is applied onto one surface of a substrate. As the method of applying the dispersion liquid onto the substrate, known methods can be used without being restricted in particular. Examples of the method include reverse rolling, direct rolling, blading, knifing, extrusion, nozzle methods, curtaining, gravure rolling, bar coating, dipping, kiss coating, spin coating, squeezing, and spraying.

When the polymerization initiator contained in the dispersion liquid is a thermal polymerization initiator, the dispersion liquid is dried, and then the dried product is cured by heating to a polymerization initiation temperature or higher. This yields the transparent conductor 10 on one surface of the substrate.

When the polymerization initiator contained in the dispersion liquid is a photopolymerization initiator, the dispersion liquid is dried, and then the dried product is cured by irradiation with light. This forms the transparent conductor 10 on one surface of the substrate.

Thus, a crosslinked product is formed between the polyfunctional compounds or between the polyfunctional compound and organic compound, whereby the transparent conductor 10 containing the conductive particles 11, crosslinked product, and binder resin 12 is obtained. Thus obtained transparent conductor 10 can favorably be used in antinoise parts, heating elements, EL electrodes, backlight electrodes, touch panels, and the like.

Second Embodiment of Transparent Conductor

The second embodiment of the transparent conductor in accordance with the present invention will now be explained. The constituents identical or equivalent to those in the first embodiment will be referred to with the same numerals while omitting their overlapping descriptions.

Figure 2:
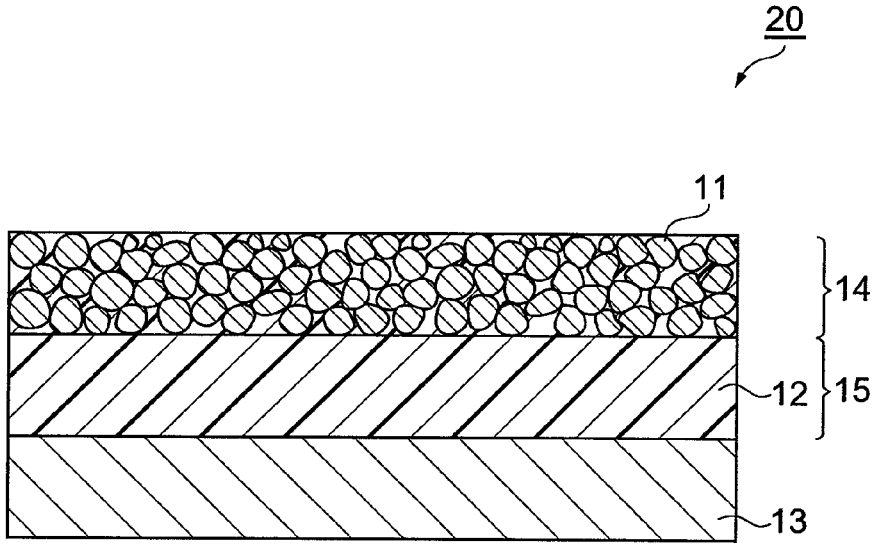
FIG. 2 is a schematic sectional view showing a second embodiment of the transparent conductor in accordance with the present invention.

FIG. 2 is a schematic sectional view showing the second embodiment of the transparent conductor in accordance with the present invention. As shown in FIG. 2, the transparent conductor 20 in this embodiment comprises a transparent conductive layer 14 including conductive particles 11, a binder resin layer 15 made of a binder resin 12, and a support 13, while the binder resin layer 15 and transparent conductive layer 14 are successively laminated on the support 13. The transparent conductive layer 14 is filled with the conductive particles 11, the binder resin 12 infiltrates and exists between the conductive particles 11, and the binder 12 firmly attaches the conductive particles 11 to each other.

The transparent conductor 20 can improve the durability. Therefore, even when repetitive pressures are applied to the transparent conductor 20, so that the transparent conductive layer 14 is repeatedly subjected to shocks, the occurrence of cracks and the like can fully be suppressed for a long period.

Though not elucidated yet, a mechanism by which the durability of the transparent conductor 20 improves as mentioned above is assumed to be as follows. When the transparent conductor 20 contains the binder resin 12 equipped with a side chain including an ester group having a long alkyl group in the transparent conductive layer 14 as mentioned above, alkyl groups of the binder resin 12 are likely to become entangled with each other. Also, as the molecular weight of the alkyl groups becomes greater, the glass transition temperature decreases, thereby increasing the flexibility and improving the surface lubricity. In addition, the long alkyl group in the binder resin 12 is easier to get entangled with a high-molecular network which is formed by a crosslinked product. The inventors assume that the durability of the transparent conductor 20 improves because of the foregoing.

The support 13 is not limited in particular as long as it is constituted by a material transparent to a high-energy line which will be explained later and visible light, and may be a known transparent film. Examples of the support 13 include polyester films such as polyethylene terephthalate (PET), polyolefin films such as polyethylene and polypropylene, polycarbonate films, acrylic films, and norbornene films (e.g., ARTON manufactured by JSR Corporation). Not only the resin films but also glass may be used as the support.

A method of manufacturing the transparent conductor 20 will now be explained. First, the conductive particles 11 are mounted on a substrate which is not shown. Preferably, an anchor layer for securing conductive particles onto the substrate is provided beforehand on the substrate. If the anchor layer is provided beforehand, the conductive particles 11 can firmly be secured onto the substrate. Favorably employable as the anchor layer is polyurethane, for example.

For securing the conductive particles 11 onto the substrate, the conductive particles 11 may be compressed toward the substrate, so as to form a compressed layer. This is useful in that the conductive particles 11 can be bonded to the substrate without forming any anchor layer. The compression can be effected by sheet pressing, roll pressing, and the like. Preferably, an anchor layer is provided on the substrate beforehand in this case as well. This can secure the conductive particles 11 more firmly.

As the substrate, not only glass, but also films such as polyester, polyethylene, and polypropylene, various plastic substrates, and the like can be used, for example.

Subsequently, the transparent conductive material excluding the conductive particles 11 (hereinafter simply referred to as "nonconductive material" as well) is applied onto one surface of the compressed layer. Here, part of the nonconductive material, i.e., transparent conductive material, infiltrates into the compressed layer.

Then, the support 13 is placed on the nonconductive material. Employable as the nonconductive material is one curable by a high-energy line which will be explained later.

When irradiated with the high-energy line in FIG. 2, the nonconductive material becomes the binder resin 12 and a crosslinked product. Thus, the binder resin 12 and crosslinked product formed by the nonconductive material infiltrating and curing between the conductive particles 11 firmly secure the conductive particles 11 to each other, thereby yielding the transparent conductive layer 14. The part of material failing to infiltrate between the conductive particles 11 cures as it is, thereby forming the binder resin layer 15. Here, the support 13 and binder resin layer 15 are further bonded to each other.

Examples of the high-energy line include light such as UV rays, electron beams, γ-rays, and x-rays.

When thus irradiated with the high-energy line, the nonconductive material cures, thereby forming the transparent conductive layer 14 and binder resin layer 15. Thereafter, the substrate is peeled off, whereby the transparent conductor 20 shown in FIG. 2 is obtained.

Preferably, the content of conductive particles 11 in the materials constituting the transparent conductive layer 14 is 10 vol % to 70 vol %. The resistance value of the transparent conductor 20 tends to increase when the content is less than 10 vol %, whereas the mechanical strength of the transparent conductive layer 14 tends to decrease when the content exceeds 70 vol %.

Though preferred embodiments of the present invention are explained in the foregoing, the present invention is not limited thereto.

For example, the transparent conductive material of the present invention may contain flame retardants, UV absorbers, colorants, plasticizers, and the like when necessary.

The transparent conductive material of the present invention may further contain viscosity enhancers such as acrylic resin. In this case, the transparent conductive material can also function as a transparent conductive paste. This transparent conductive paste can fully prevent the electric resistance value from changing with time even in a high-humidity environment. Since the transparent conductive paste has a fixed viscosity, it can be applied uniformly to the substrate and easily to narrow parts and uneven parts as well. The transparent conductive paste can be obtained by adding a viscosity enhancer such as acrylic resin to the dispersion liquid and then drying the liquid.

Though the method of manufacturing the transparent conductor 20 explained in the forgoing uses a transparent conductive material containing substances curable by the high-energy line, those curable by heat may be used instead.

The present invention will now be explained more specifically with reference to examples, which do not restrict the present invention.

Making of Conductive Particles

An aqueous solution dissolving 19.9 g of indium chloride tetrahydrate (manufactured by Kanto Chemical Co., Inc.) and 2.6 g of stannic chloride (manufactured by Kanto Chemical Co., Inc.) into 980 g of water and a 10-fold dilution of aqueous ammonia (manufactured by Kanto Chemical Co., Inc.) with water were mixed while being prepared, so as to produce a white precipitate (coprecipitate).

The liquid containing thus produced precipitate was subjected to solid-liquid separation by a centrifuge, so as to yield a solid. The solid was put into 1,000 g of water and dispersed by a homogenizer. The resulting dispersion was subjected to solid-liquid separation by a centrifuge. After repeating the dispersion and solid-liquid separation five times, the solid was dried and then heated in a nitrogen atmosphere at 600° C. for 1 hr, so as to yield fine particles of ITO (conductive particles) having a primary particle size of 20 to 30 nm. A mixed liquid was prepared from the fine particles of ITO and water. Here, the conductive particle content in the mixed liquid was set to 1 mass %. The pH of the mixed liquid measured by a pH meter was 3.0, whereas chlorine was less than the detectable limit.

EXAMPLE 1

With 300 parts by mass of ethanol added, 100 parts by mass of the fine particles of ITO having a primary particle size of 20 to 30 nm obtained as mentioned above were dispersed by a disperser. The resulting coating liquid was applied onto a PET film having a width of 100 mm and a thickness of 50 μm by bar coating, and then dried with a hot air at 50° C. fed thereto. The thickness of the ITO coating in thus obtained film was 1.7 μm.

Subsequently, using a roll press equipped with a pair of metal rolls (rolls having surfaces plated with hard chromium) each having a diameter of 140 mm, the ITO film was compressed at a pressure of 1,000 N/mm per unit length in the film width direction and a roll rotation speed of 5 m/min. The thickness of the ITO coating after the compression was 1.0 μm.

The compressed ITO film obtained by the foregoing was secured to the glass substrate. Here, the ITO film was secured to the glass substrate in the state where the PET film faced the glass substrate. A binder liquid obtained by mixing the following components was applied to the ITO coating side of the compressed ITO film by bar coating, and MEK was evaporated from the coated product with a hot air at 80° C.

| | |
|---|---|
| Polyethyl methacrylate (having a weight-average molecular weight Mw of 500,000) | 40 parts by mass |
| Ethoxylated glycerol triacrylate (polyfunctional compound; product name: A-GLY-20E manufactured by Shin-Nakamura Chemical Co., Ltd.) | 20 parts by mass |
| Polyethylene glycol dimethacrylate (polyfunctional compound; product name: 14G manufactured by Shin-Nakamura Chemical Co., Ltd.) | 20 parts by mass |
| Trimethylolpropane triacrylate (polyfunctional compound; product name: TMPT manufactured by Shin-Nakamura Chemical Co., Ltd.) | 10 parts by mass |
| Urethane-modified acrylate (polyfunctional compound; product name: UA-512 manufactured by Shin-Nakamura Chemical Co., Ltd.) | 10 parts by mass |
| Photopolymerization initiator (ESACURE ONE manufactured by Lamberti S.p.A.) | 2 parts by mass |
| Methylethylketone (MEK manufactured by Kanto Chemical Co., Inc.) | 200 parts by mass |

The film thickness of the binder after evaporating MEK as mentioned above was 3.0 μm. Thereafter, a PET film having a width of 100 mm and a thickness of 200 μm was attached to the binder-coated surface of the film coated with the binder, and the binder was irradiated with light from the attached film side in the air. Finally, the multilayer body made of the glass substrate and PET film was peeled off, so as to yield a transparent conductor. Here, a metal halide lamp was used as a light source, the irradiance in the wavelength region of 320 nm to 390 nm was 3.0 W/cm$^2$, and the integrated irradiance was 2.0 J/cm$^2$.

EXAMPLE 2

A transparent conductor was obtained as in Example 1 except that polyethyl methacrylate was replaced with polybutyl methacrylate (having a weight-average molecular weight Mw of 500,000).

EXAMPLE 3

A transparent conductor was obtained as in Example 1 except that polyethyl methacrylate was replaced with ethyl methacrylate/lauryl methacrylate copolymer (having a weight-average molecular weight Mw of 500,000). Here, the molar ratio between ethyl methacrylate and lauryl methacrylate was 8:2.

EXAMPLE 4

A transparent conductor was obtained as in Example 1 except that polyethyl methacrylate was replaced with ethyl methacrylate/stearyl methacrylate copolymer (having a weight-average molecular weight Mw of 500,000). Here, the molar ratio between ethyl methacrylate and stearyl methacrylate was 9:1.

EXAMPLE 5

A transparent conductor was obtained as in Example 1 except that polyethyl methacrylate was replaced with ethyl methacrylate/pentafluoropropyl methacrylate copolymer (having a weight-average molecular weight Mw of 500,000). Here, the molar ratio between ethyl methacrylate and pentafluoropropyl methacrylate was 5:5.

EXAMPLE 6

A transparent conductor was obtained as in Example 1 except that polyethyl methacrylate (having a weight-average molecular weight Mw of 500,000) was replaced with polyethyl methacrylate (having a weight-average molecular weight Mw of 2,300,000).

EXAMPLE 7

A transparent conductor was obtained as in Example 1 except that polyethyl methacrylate was replaced with ethyl methacrylate/lauryl methacrylate copolymer (having a weight-average molecular weight Mw of 1,400,000).

Here, the molar ratio between ethyl methacrylate and lauryl methacrylate was 9:1.

EXAMPLE 8

A transparent conductor was obtained as in Example 1 except that polyethyl methacrylate was replaced with ethyl methacrylate/trifluoromethyl methacrylate copolymer (having a weight-average molecular weight Mw of 1,600,000).

Here, the molar ratio between ethyl methacrylate and trifluoromethyl methacrylate was 5:5.

EXAMPLE 9

A transparent conductor was obtained as in Example 1 except that polyethyl methacrylate was replaced with ethyl methacrylate/stearyl methacrylate copolymer (having a weight-average molecular weight Mw of 2,120,000).

Here, the molar ratio between ethyl methacrylate and stearyl methacrylate was 9.5:0.5.

EXAMPLE 10

A transparent conductor was obtained as in Example 1 except that polyethyl methacrylate was replaced with ethyl methacrylate/mixed methacrylate (BLEMMER SLMA manufactured by NOF Corporation; a mixture constituted by those in which the R part constituting the ester group had a carbon atom number of 12 to 13) copolymer (having a weight-average molecular weight Mw of 1,400,000).

Here, the molar ratio between ethyl methacrylate and mixed methacrylate was 8:2.

EXAMPLE 11

A transparent conductor was obtained as in Example 1 except that polyethyl methacrylate was replaced with ethyl methacrylate/trifluoromethacrylate copolymer (having a weight-average molecular weight Mw of 2,260,000).

Here, the molar ratio between ethyl methacrylate and trifluoromethacrylate was 1:1.

EXAMPLE 12

A transparent conductor was obtained as in Example 1 except that polyethyl methacrylate was replaced with ethyl methacrylate/trifluoromethacrylate copolymer (having a weight-average molecular weight Mw of 1,630,000).

Here, the molar ratio between ethyl methacrylate and trifluoromethacrylate was 3:7.

EXAMPLE 13

A transparent conductor was obtained as in Example 1 except that polyethyl methacrylate was replaced with ethyl methacrylate/trifluoromethacrylate copolymer (having a weight-average molecular weight Mw of 1,720,000).

Here, the molar ratio between ethyl methacrylate and trifluoromethacrylate was 1:9.

EXAMPLE 14

A transparent conductor was obtained as in Example 1 except that polyethyl methacrylate was replaced with polyisobutyl methacrylate (having a weight-average molecular weight Mw of 500,000).

COMPARATIVE EXAMPLE 1

A transparent conductor was obtained as in Example 1 except that polyethyl methacrylate was replaced with polymethyl methacrylate (having a weight-average molecular weight Mw of 500,000).

COMPARATIVE EXAMPLE 2

A transparent conductor was obtained as in Example 1 except that polyethyl methacrylate was replaced with ethyl methacrylate/isobornyl methacrylate copolymer (having a weight-average molecular weight Mw of 500,000).

Here, the molar ratio between ethyl methacrylate and isobornyl methacrylate was 5:5.

Moisture Resistance Evaluation of Transparent Conductor In the following manner, electric resistance was evaluated in the transparent conductors obtained in Examples 1 to 14 and Comparative Examples 1 and 2. Namely, each of the transparent conductors obtained as in the foregoing was cut into a 50-mm square, an electric resistance value was measured at a predetermined measurement point of each transparent conductive layer with a 4-terminal, 4-probe type surface resistance meter (MCP-T600 manufactured by Mitsubishi Chemical Corporation), and thus measured value was defined as initial surface electric resistance value. Thereafter, the transparent conductor was left for 1,000 hr in an environment of 60° C., 95% RH and then taken out. At the time when the transparent conductor was cooled to room temperature thereafter, the electric resistance value was measured again at the above-mentioned measurement point, and thus obtained value was defined as surface electric value after loading. Then, the surface resistance change ratio was calculated according to the following equation:

Surface resistance change ratio (%) =100×(surface electric value after loading−initial surface electric resistance value)/initial surface electric resistance value. Table 1 shows thus obtained results.

Durability Evaluation

Double-sided adhesive tapes each having a size of 5 mm×45 mm with a thickness of 100 μm were attached to the surface of the transparent conductive layer of each of the transparent conductors obtained in Examples 1 to 14 and Comparative Examples 1 and 2 such as to form a square frame of 50 mm×50 mm. A glass sheet having a size of 50 mm×50 mm was attached to the double-sided adhesive tapes while being aligned with the frame of double-sided adhesive tapes. This yielded a touch panel for testing in which the transparent conductive film and glass sheet were arranged such as to oppose each other. A pen made of polyacetal having a pointed part of R=0.8 was brought into contact with the touch panel at near the center of its transparent conductive film. In this state, a keying load test in which a load of 200 g was repeatedly exerted on the polyacetal pen for 100,000 times in an environment of 25° C., 50% RH was performed. After the test, the transparent conductive film was peeled off from the glass sheet, and the resistance value of the transparent conductive layer surface was measured as mentioned above. Thus measured value was defined as resistance value after loading. The ratio of change of the resistance value after loading with respect to the initial resistance value was calculated as surface resistance change ratio. Namely, the surface resistance change ratio was calculated according to the above-mentioned equation. Table 1 shows thus obtained results.

TABLE 1

| | | | Moisture resistance evaluation | | | Durability evaluation | | |
|---|---|---|---|---|---|---|---|---|
| | Organic compound | Mw ($\times 10^4$) | Initial resistance value (Ω/□) | Resistance value after loading (Ω/□) | Resistance change ratio (%) | Initial resistance value (Ω/□) | Resistance value after loading (Ω/□) | Resistance change ratio (%) |
| Example 1 | PEMA | 50 | 590 | 1139 | 93 | 604 | 612 | 1.3 |
| Example 2 | PBMA | 50 | 567 | 1077 | 90 | 589 | 596 | 1.2 |
| Example 3 | EMA + LMA | 50 | 597 | 1110 | 86 | 594 | 600 | 1.0 |
| Example 4 | EMA + SMA | 50 | 602 | 1114 | 85 | 591 | 597 | 1.0 |
| Example 5 | EMA + FMA | 50 | 588 | 1164 | 98 | 576 | 583 | 1.2 |
| Example 6 | EMA | 230 | 574 | 1027 | 79 | 566 | 571 | 0.9 |
| Example 7 | EMA + LMA | 140 | 579 | 1025 | 77 | 590 | 596 | 1.1 |
| Example 8 | EMA + TFMMA | 160 | 566 | 1070 | 89 | 571 | 577 | 1.0 |
| Example 9 | EMA + SMA | 212 | 601 | 1022 | 70 | 593 | 597 | 0.7 |
| Example 10 | EMA + mixed MA | 217 | 582 | 1019 | 75 | 571 | 576 | 0.8 |
| Example 11 | EMA + 3FMA | 226 | 558 | 1032 | 85 | 540 | 544 | 0.8 |
| Example 12 | EMA + 3FMA | 163 | 547 | 1034 | 89 | 556 | 561 | 0.9 |
| Example 13 | EMA + 3FMA | 172 | 540 | 1037 | 92 | 543 | 547 | 0.9 |
| Example 14 | iBMA | 50 | 595 | 1416 | 138 | 601 | 607 | 1.0 |
| Comparative Example 1 | MMA | 50 | 593 | 1429 | 141 | 608 | 619 | 1.8 |
| Comparative Example 1 | EMA + i-bornyl MA | 50 | 589 | 1431 | 143 | 584 | crack | — |

As can be seen from Table 1, the transparent conductors of Examples 1 to 14 have been found superior to those of Comparative Examples 1 and 2 in terms of durability. In particular, the results of Examples 2 and 14 show that the case where the alkyl group of the ester group is a linear alkyl group improves the resistance change ratio more and thus is better in moisture resistance as compared with the case where the alkyl group is a branched alkyl group.

The foregoing results prove that the transparent conductive material of the present invention can improve the durability.

As explained in the foregoing, the present invention provides a transparent conductive material and transparent conductor which can improve the durability of the transparent conductor.

What is claimed is:

1. A transparent conductive material comprising:

a conductive particle;

a polyfunctional compound; and an organic compound having a side chain including an ester group;

wherein the ester group is expressed by the following formula:

—COOR where R is a substituted or unsubstituted linear alkyl group having a carbon atom number of 2 or greater.

2. A transparent conductive material according to claim 1, wherein the alkyl group is a fluorine-substituted alkyl group.

3. A transparent conductive material according to claim 1, wherein the organic compound has a weight-average molecular weight of at least 100,000.

4. A transparent conductor comprising:

a conductive particle;

a crosslinked product; and a binder resin having a side chain including an ester group;

wherein the ester group is expressed by the following formula:

—COOR where R is a substituted or unsubstituted linear alkyl group having a carbon atom number of 2 or greater.

5. A transparent conductor according to claim 4, wherein the alkyl group is a fluorine-substituted alkyl group.

6. A transparent conductive material according to claim 1, wherein the organic compound comprises a non-crosslinked product.

7. A transparent conductor according to claim 4, wherein the binder resin comprises a non-crosslinked product.

8. A transparent conductive material according to claim 1, wherein the organic compound comprises at least one of polyethyl methacrylate, polybutyl methacrylate, ethyl methacrylate/lauryl methacrylate copolymer, ethyl methacrylate/stearyl methacrylate copolymer, ethyl methacrylate/pentafluoropropyl methacrylate copolymer, ethyl methacrylate/trifluoromethyl methacrylate copolymer, ethyl methacrylate/mixed methacrylate copolymer, and ethyl methacrylate/trifluoromethacrylate copolymer.

9. A transparent conductor according to claim 4, wherein the binder resin comprises at least one of polyethyl methacrylate, polybutyl methacrylate, ethyl methacrylate/lauryl methacrylate copolymer, ethyl methacrylate/stearyl methacrylate copolymer, ethyl methacrylate/pentafluoropropyl methacrylate copolymer, ethyl methacrylate/trifluoromethyl methacrylate copolymer, ethyl methacrylate/mixed methacrylate copolymer, and ethyl methacrylate/trifluoromethacrylate copolymer.

* * * * *